United States Patent [19]

Kochi et al.

[11] Patent Number: 4,670,823

[45] Date of Patent: Jun. 2, 1987

[54] VEHICLE LAMP HAVING INNER LENS

[75] Inventors: Takeshi Kochi, Fuchu; Akihiro Iwaki, Ichihara; Masayoshi Tajima, Tokyo, all of Japan

[73] Assignee: Stanley Electric Co., Ltd., Tokyo, Japan

[21] Appl. No.: 687,639

[22] Filed: Dec. 31, 1984

[51] Int. Cl.[4] ..... F21V 5/00

[52] U.S. Cl. ..... 362/268; 362/331; 362/336

[58] Field of Search ..... 362/255, 256, 268, 317, 362/326, 331, 335, 336, 337, 339, 61

[56] References Cited

U.S. PATENT DOCUMENTS 1,443,756 1/1923 Osann ..... 362/331
2,310,810 2/1943 Rolph ..... 362/331
3,334,958 8/1967 Appeldorn ..... 362/331
4,316,241 2/1982 Gulliksen ..... 362/268

FOREIGN PATENT DOCUMENTS 2433155 4/1980 France ..... 362/331

*Primary Examiner*—Craig R. Feinberg
*Assistant Examiner*—David A. Okonsky
*Attorney, Agent, or Firm*—Weingarten, Schurgin, Gagnebin & Hayes

[57] ABSTRACT

This invention provides a vehicle lamp wherein an inner lens made of a heat-resistant resin film and having a Fresnel cut pattern is mounted in tight contact with an inner surface of an outer lens mounted on a front surface of the vehicle lamp.

4 Claims, 7 Drawing Figures

FIG. 1
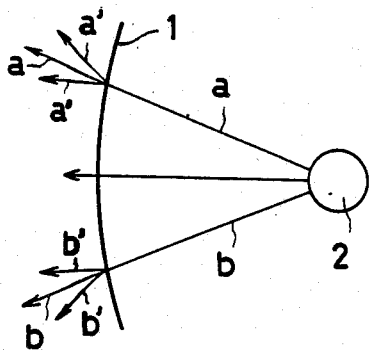
PRIOR ART
FIG. 2
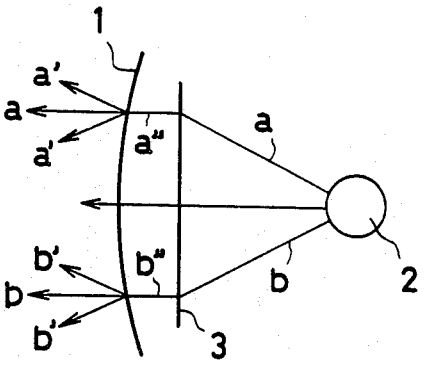
PRIOR ART
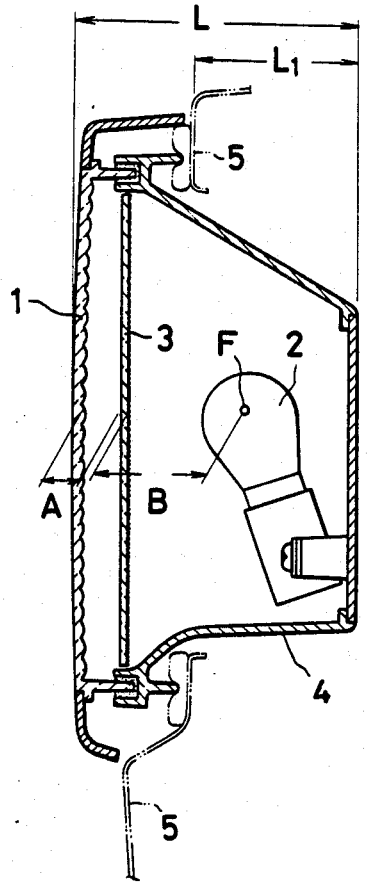
FIG. 3
PRIOR ART

VEHICLE LAMP HAVING INNER LENS

BACKGROUND OF THE INVENTION (1.) Field of the Invention

The present invention relates to a vehicle lamp such as a tail lamp, a turn signal lamp and a stop lamp and, more particularly, to a lamp having an inner lens for converting light beams from a light source to parallel light beams.

(2.) Description of the Prior Art

In general, most vehicle lamps such as tail lamps, turn signal lamps and stop lamps excluding head lamps do not have a parabolic reflector as in a head lamp since their mounting positions and spaces are limited and diverging light beams are required. In such a conventional lamp without a parabolic reflector, as shown in FIG. 1, as soon as light beams a and b from a bulb 2 pass through a lens 1, the light beams a and b are emitted as diverging light beams a′ and b′ outside the lamp. However, the light beams a and b are incident along diverging directions (i.e., along directions inclined with respect to the lens surface). These beams are diverged by the lens 1, so that the divergence of light beams passing through the lens 1 becomes great. The illuminance of the lamp as a whole is lowered, thereby providing only poor lighting performance.

In order to solve this problem, a Fresnel cut inner lens is used in a conventional vehicle lamp. As shown in FIG. 2, an inner lens 3 is disposed between the lens 1 and the bulb 2. The light beams a and b from the bulb 2 are converted to parallel light beams a″ and b″ which are directed to the lens 1. These parallel light beams a″ and b″ are diverged by the lens 1, thereby eliminating wasteful light components and hence improving lighting performance.

A typical conventional vehicle lamp having an inner lens of this type is illustrated in FIG. 3. Referring to FIG. 3, reference numeral 1 denotes a lens, i.e., an outer lens; 2, a bulb; and 3, an inner lens. The outer lens 1, the bulb 2 and the inner lens 3 are mounted in a housing 4 of the lamp. The housing 4 is mounted in a vehicle body 5. The outer and the inner lenses 1 and 3 are made of acrylic resin. A distance B between the inner lens 3 and the bulb 2 (i.e., a filament F) is generally 30 mm or more in consideration of heat resistance of the inner lens. A distance A between the inner and outer lenses 3 and 1 is generally 10 mm or more. This is because the pitch of the Fresnel cut inner lens 3 is excluded from visibility since the pitch is about 0.5 mm. It should be noted that the inner lens 3 is subjected to Fresnel cutting which is performed by a molding means. In consideration of molding precision, the inner lens 3 comprises a plate having a basic thickness of about 2 mm.

In this conventional vehicle lamp, an axial length of a lamp having a plurality of illumination functions such as a combination lamp is increased. When such a combination lamp is mounted in the vehicle body, an axial length L of the lamp as a whole and an axial length $L_1$ of the lamp portion extending inside the vehicle body are relatively long. The mounting space of the vehicle body must be relatively large, thereby restricting versatility of vehicle body pressing. The conventional vehicle lamp cannot be made compact.

In addition to this disadvantage, the parallel beams directing toward the outer lens 1 through the inner lens 3 are not present in the peripheral portion of the outer lens 1. The effective illumination surface of the outer lens is decreased to degrade the lamp functions.

SUMMARY OF THE INVENTION

It is an object of the present invention to provide a vehicle lamp wherein an axial length thereof is greatly decreased, an ineffective illumination region at an outer periphery of an outer lens is eliminated, and divergence of light in unnecessary directions can be prevented.

In order to achieve the above object of the present invention, there is provided a vehicle lamp having an inner lens, the inner lens being made of a heat-resistant resin film having a basic thickness of 0.3 to 1.0 mm and having a Fresnel cut pattern with a pitch of 0.3 mm or less, the inner lens being mounted in contact with an outer lens.

BRIEF DESCRIPTION OF THE DRAWINGS

FIG. 1 is a representation for explaining the principle of illumination and diverging beams of a conventional vehicle lamp without an inner lens;

FIG. 2 is a representation for explaining the principle of illumination and diverging beams of a conventional vehicle lamp with an inner lens;

FIG. 3 is a sectional view of a conventional vehicle lamp with an inner lens;

DESCRIPTION OF THE PREFERRED EMBODIMENTS

Figure 4:
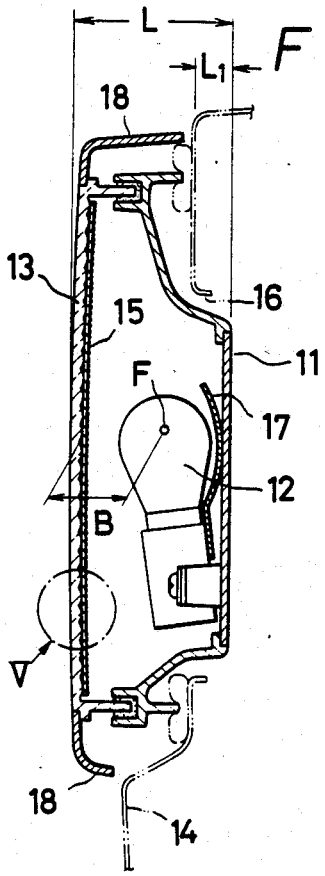
FIG. 4 is a sectional view of a vehicle lamp according to a first embodiment of the present invention.
Figure 5:
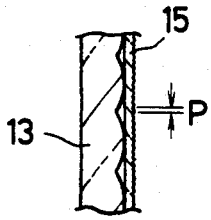
FIG. 5 is an enlarged sectional view of a portion represented by V of FIG. 4.

A vehicle lamp according to a first embodiment of the present invention will be described with reference to FIG. 4. A bulb 12 is mounted in a housing 11. A flat outer lens 13 made of acrylic resin is mounted at the front opening of the housing 11. The outer lens 13 has an inner surface of a convex cut pattern which diverges light. Reference numeral 15 denotes an inner lens made of a heat-resistant resin such as polycarbonate which has a better heat-resistant property than acrylic resin. The inner lens 15 comprises a film having a basic thickness of 0.3 to 1.0 mm. The inner surface of the inner lens 15 has a Fresnel cut pattern whose pitch is 0.3 mm or less. As shown in FIG. 5, the outer surface of the inner lens 15 is in tight contact with the inner surface of the outer lens 13. A distance B between the inner lens 15 and a light source F of a bulb 12 is set to about 20 mm. Thus, the distance between the outer and inner lenses 13 and 15 becomes substantially zero, thereby decreasing the axial length L of the lamp as a whole. In addition, the length $L_1$ of the lamp portion extending inside a vehicle body 14 from a mounting hole 16 of the vehicle body 14 can also be decreased. Furthermore, since the pitch P of the Fresnel cut pattern of the inner lens 15 is 0.3 mm or less, irregular light distribution cannot be visually observed when light beams are emitted through the outer lens 13 even if the inner lens 15 is in tight contact with the outer lens 13.

It should be noted that reference numeral 17 denotes a heat-insulating plate/reflector; and 18, a cover.

Figure 6:
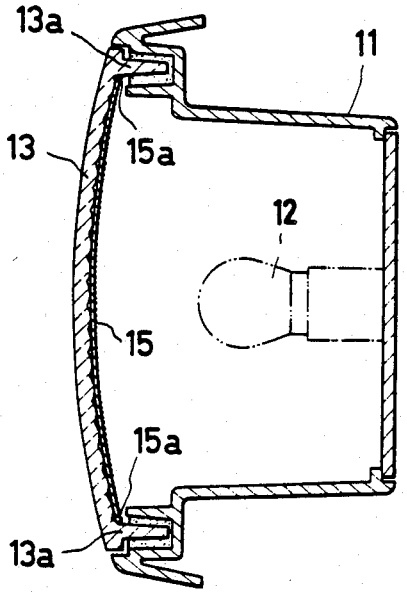
FIG. 6 is a sectional view of a vehicle lamp according to a second embodiment of the present invention.

A vehicle lamp according to a second embodiment of the present invention will be described with reference to FIG. 6. The same reference numerals in the second embodiment denote the same parts as in the first embodiment. The vehicle lamp of the second embodiment is proposed when a lamp receiving portion of the vehicle body permits a long axial length. An arcuated outer lens 13 is mounted on the front opening of a housing 11. The inner surface of the outer lens 13 has a convex lens cut pattern. An inner lens 15 is arranged in the vicinity of the inner surface of the outer lens 13 and has a shape corresponding to the inner surface thereof. The inner lens 15 comprises a thin flexible plate made of polycarbonate resin having a good heat-resistant property. A basic thickness of the inner lens 15 is about 1.0 mm or less, and a Fresnel cut pattern has a pitch of about 0.2 mm. A peripheral portion 15*a* of the inner lens 15 is fixed by ultrasonic welding or thermal caulking at the base of an insert portion 13*a* of the outer lens 13. Even if the inner lens 15 is mounted in tight contact with the outer lens 13 having a large radius of curvature, light beams passing through the inner lens 15 become substantially parallel beams, thereby obtaining the same effect as in the first embodiment. In the second embodiment, the ineffective illumination region of the outer lens 13 can be eliminated, and light beams will not diverge along unnecessary directions.

Figure 7:
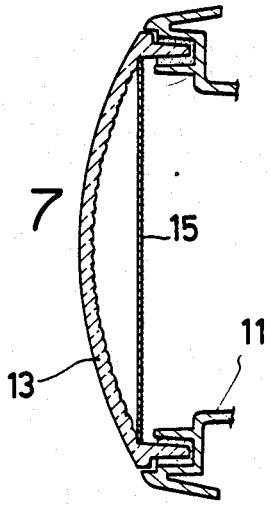
FIG. 7 is a sectional view showing the main part of a vehicle lamp according to a third embodiment of the present invention.

In a third embodiment shown in FIG. 7, a positional relationship between an inner lens 15 and an outer lens 13 having a smaller radius of curvature is illustrated. In this embodiment, the inner lens 15 does not conform in shape to the arcuated surface of the outer lens 13. The peripheral portion of the outer surface of the inner lens 15 is fixed by ultrasonic welding at the corresponding peripheral portion of the inner surface of the outer lens 13. In this case, the outer and inner lenses 13 and 15 are partially in tight contact with each other. A small space is partially present between the outer and inner lenses 13 and 15. The third embodiment is substantially the same as the first and second embodiments since the outer and inner lenses 13 and 15 are integrally welded. In the third embodiment, therefore, the ineffective illumination surface of the outer lens 13 can be eliminated in the same manner as in the first and second embodiments.

In vehicle lamps with an inner lens according to the present invention, the inner lens is arranged in tight contact with or in the vicinity of the inner surface of an outer lens, and the inner and outer lenses are welded integrally to each other. In addition, since the inner lens comprises a heat-resistant film which can be arranged along the arcuated inner surface of the outer lens, and since the distance between the inner lens and the light source can be decreased, the axial length of the lamp as a whole can be greatly decreased. The mounting position and space of the vehicle lamp on the vehicle body will not be restricted according to the present invention. Furthermore, the ineffective illumination region of the outer lens can be eliminated, and the inner lens comprises the heat-resistant film, thereby simplifying the manufacturing process. The inner lens can be easily welded or adhered to the outer lens, thus simplifying assembly.

What is claimed is:

1. A vehicle lamp comprising an inner lens made of heat-resistant resin film and having a Fresnel cut pattern mounted in tight contact with an inner surface of an outer lens having a convex cut mounted on a front surface of said vehicle lamp wherein said inner lens provides substantially parallel beams of light and said outer lens diverges said beams of light, and said convex cut comprising a plurality of intersecting arcs as viewed in cross section, each said arc having a substantially equal radius of curvature, a point of intersection between sach said arc defining a respective end point of a respective chord, each said chord having a length much greater than a pitch of said Fresnel cut pattern.

2. A vehicle lamp according to claim 1, wherein said heat-resistant resin film has a basic thickness of 0.3 to 1.0 mm.

3. A vehicle lamp according to claim 1, wherein said heat-resistant resin film comprises polycarbonate resin.

4. A vehicle lamp according to claim 1, wherein said Fresnel cut pattern has a pitch of not more than 0.3 mm.

* * * * *